United States Patent [19]

Novev et al.

[11] 4,279,708

[45] Jul. 21, 1981

[54] COMBINED BRIGHTENER IN SULFAMATE SILVER ELECTROPLATING BATHS

[75] Inventors: Todor V. Novev; Sava D. Ovcharov; Nikola S. Yordanov; Jivka P. Acheva; Yordan I. Yordanov; Maria L. Mandova, all of Sofia, Bulgaria

[73] Assignee: Institute po Zashtita na Metalite ot Korroziya, Sofia, Bulgaria

[21] Appl. No.: 125,785

[22] Filed: Feb. 29, 1980

[30] Foreign Application Priority Data

Jul. 6, 1979 [BG] Bulgaria ..... 44224

[51] Int. Cl.[3] ..... C25D 3/46

[52] U.S. Cl. ..... 204/46 R

[58] Field of Search ..... 204/DIG. 2, 46 R, 43 R, 204/109; 106/1.26

[56] References Cited

U.S. PATENT DOCUMENTS

| | | | |
|---|---|---|---|
| 3,969,219 | 7/1976 | Kosmos | 204/DIG. 2 X |
| 3,972,789 | 8/1976 | Eppensteiner et al. | 204/DIG. 2 X |
| 4,071,418 | 1/1978 | James | 204/DIG. 2 X |
| 4,071,419 | 1/1978 | James | 204/DIG. 2 X |
| 4,093,523 | 6/1978 | Henricks et al. | 204/DIG. 2 X |

OTHER PUBLICATIONS

R. Piontelli, Korrosion und Metallschutz, 19, 110–113, (1943).

V. A. Kalkaris et al., Proc. Litovian Institutes, Chem. & Chem. Tech., 10, 119–125, (1969).

T. V. Novev et al., "Non-Cyanide Bath for Bright Silver Plating," 23116, (1975).

S. Tajima et al., J. Electrochem. Soc., Japan, 22, 3, 106–112, (1954), and 22, 5, 211–213, (1954).

*Primary Examiner*—G. L. Kaplan

*Attorney, Agent, or Firm*—Karl F. Ross

[57] ABSTRACT

A brightening composition is disclosed for an ammonia-sulfamate silver plating bath wherein said composition consists essentially of a pyridine-monocarboxylic acid or amide in a concentration of 0.5 to 10.0 g/l, in combination with at least one dye selected from the group consisting of an azo dye, an acid anthraquinone dye, and an arylamino dye, wherein the dye is present in a concentration of 0.01 to 2.0 g/l.

5 Claims, No Drawings

COMBINED BRIGHTENER IN SULFAMATE SILVER ELECTROPLATING BATHS

This invention relates to the composition of a combined brightener for the electrodeposition of bright silver coatings from an ammonia-sulfamate bath. The deposits are designed for technical and decorative use.

From the patent and technical data available, sulfamate baths for the electrodeposition and refining of silver are known. The acid sulfamate bath is utilized mostly in the field of silver refining, while the alkaline baths are the ones used in silver electrodeposition.

Some colloidal and definite organic compounds are used as brighteners in the alkaline sulfamate electrolytes—such as gelatin, pyridine derivatives—applied alone or in combination with colloidal substances. See Pionelli, K., ON THE APPLICATION OF SULFAMATE BATHS FOR ELECTROPLATING OF COATINGS AND FOR ANODIC OXIDATION, "Korrosion und Metallschutz" 19, 110–113, (Milan 1943) and Tajima et al., ELECTRODEPOSITING AND REFINING OF SILVER WITH SULFAMATE BATHS, Journal of the Electrochemical Society of Japan, 22,3 106–112 (1954) and 22,5 211–213 (1954). See Kalkaris, V. A. et al, INVESTIGATIONS ON SILVER ELECTROPLATING FROM FLUOROBORATE AND SULPHAMATE BATHS, Proceedings of the Litovian Institutes, Chemistry and Chemical Technology, 10, 119–125 (1969) and Novev et al, NON-CYANIDE BATH FOR BRIGHT SILVER PLATING, 23116 (1975).

The basic shortcoming of the sulfamate electrolytes when using the above-mentioned brighteners is their rather limited exploitation possibilities. For example—when gelatin is added, the sulfamate bath produces bright deposits only by rack plating working at a current density of max. 0.8 A/dm$^2$. Besides, gelatin is a reducing agent and when present in the bath, tends to form a residue of elemental silver. When pyridine derivatives are being used—some of the disadvantages of the colloidal additives are avoided, but the narrow current density interval (0.5–1.5 A/dm$^2$) remains.

The object of the present invention is to considerably improve the productivity of the ammonia-sulfamate baths for depositing bright silver coatings for use in the electronic and electrical industry and in jewelry.

This problem is solved by adding to an ammonia-sulfamate bath with the following composition:

Silver sulfamate: 15–150 g/l
Ammonium sulfamate: 30–350 g/l
Potassium sulfamate: 0.1–100 g/l
Ammonium hydrooxide: up to pH 7.5–11.0
a combined brightener consisting of a pyridine derivative (monocarboxylic acid or its amide, in a concentration of 0.5–10 g/l with one (or several) soluble dyes from the following types: azo-dyes, acid anthraquinone dyes, arylamine dyes—in concentration 0.01–2.0 g/l.

The advantages to the application of the combined brightener for ammonia-sulfamate silver baths are several: the electrolyte produces bright hard silver deposits in a wide interval of current densities (by rack plating and a temperature of 25° C. the applied current density ranges up to 3 A/dm$^2$; also by rack plating and a temperature of 38° C., one can make use of current densities up to 5 A/dm$^2$. If the bath is agitated, the maximum working current density reaches 10 A/dm$^2$).

The combined brightener is characterized by a high brightening capacity—up to 60 A.h/l. The interval of anodic current densities is considerably widened, while the anodic efficiency remains 100%.

The invention is illustrated by the following examples:

EXAMPLE 1

It is carried out with an electrolyte with the following composition and by the following conditions:

| | |
|---|---|
| Silver (as silver sulfamate) | 40 g/l |
| Ammonium sulfamate | 250 g/l |
| Potassium sulfamate | 50 g/l |
| Nicotinic acid | 5 g/l |
| 4(3,6-disulpho,8-hydroxydiazonaphthyl) 1-phenylaminonaphthol,8-sulpho acid | 0.08 g/l |
| Ammonia hydrooxide | up to pH = 9.5 |
| Temperature | 25° C. |
| Current density | |
| - agitated solution | 0.5–3.0 A/dm$^2$ |
| - not agitated | 0.5–6.0 A/dm$^2$ |

The produced deposits are bright, ductile, displaying increased hardness ($H_v$=135 kg/mm$^2$—by $D_k$=2 A/dm$^2$)

EXAMPLE 2

It is carried out with a bath with the following composition and by the following conditions:

| | |
|---|---|
| Silver (as silver sulfamate) | 35 g/l |
| Ammonium sulfamate | 200 g/l |
| Potassium sulfamate | 20 g/l |
| Nicotinic acid | 3 g/l |
| Bromeamine acid | 0.05 g/l |
| Ammonium hydrooxide | up to pH = 9.7 |
| Temperature | 23° C. |
| Current density | |
| - agitated solution | 0.5–2.8 A/dm$^2$ |
| - not agitated | 0.5–5.0 A/dm$^2$ |

The produced deposits are bright, ductile and display increased hardness—$H_v$=128 kg/mm$^2$ (by $D_k$=1.8 A/dm$^2$).

EXAMPLE 3

It is carried with a bath—with the following composition and by the following conditions:

| | |
|---|---|
| Silver (as silver sulfamate) | 50 g/l |
| Ammonium sulfamate | 300 g/l |
| Potassium sulfamate | 5 g/l |
| Isonicotinic acid | 2 g/l |
| Methylene blue ($C_{16}H_{18}N_3Cl$) | 0.08 g/l |
| Ammonium hydrooxide | up to pH = 9.4 |
| Temperature | 26° C. |
| Current density | |
| - agitated solution | 0.5–2.9 A/dm$^2$ |
| - not agitated | 0.5–5.5 A/dm$^2$ |

The produced deposits are bright, ductile and display increased hardness—$H_v$=130 kg/mm$^2$ (by $D_k$=2.0 A/dm$^2$)

EXAMPLE 4

It is worked with a bath with the following composition and by the following conditions:

| | |
|---|---|
| Silver (as silver sulfamate) | 60 g/l |
| Ammonium sulfamate | 200 g/l |
| Potassium sulfamate | 50 g/l |
| Nicotinamide | 5 g/l |
| Methylene blue | 0.04 g/l |
| 4(3,6-disulpho,8-hydroxydiazonaphthyl) 4-methyl,1-phenylaminonaphthol, 8-sulpho acid | 0.12 g/l |
| Ammonium hydrooxide | up to pH = 9.5 |
| Temperature | 35° C. |
| Current density | |
| - agitated solution | 0.5–4.5 A/dm$^2$ |
| - not agitated | 0.5–10.0 A/dm$^2$ |

The produced deposits are bright, ductile and display increased hardness—$H_v$=145 kg/mm$^2$ (by $D_k$=3.5 A/dm$^2$).

We claim:

1. In an ammonia-sulfamate silver electroplating bath, a brightening composition consisting essentially of a pyridine-monocarboxylic acid or amide in a concentration of 0.5 to 10.0 g/l, in combination with at least one dye selected from the group consisting of an azo dye, an acid anthraquinone dye, and an arylamino dye wherein the dye is present in a concentration of 0.01 to 2.0 g/l.

2. The electroplating bath defined in claim 1 wherein the pyridine monocarboxylic acid is nicotinic acid.

3. The electroplating bath defined in claim 1 wherein the pyridine monocarboxylic acid is isonicotinic acid.

4. The electroplating bath defined in claim 1 wherein the pyridine monocarboxylic amide is nicotinamide.

5. A method for improving the productivity of an ammonia sulfamate bath used for electrodepositing bright silver coatings wherein the ammonia sulfamate bath has the following composition:

silver sulfamate: 15–150 g/l
ammonium sulfamate: 30–350 g/l
potassium sulfamate: 0.1 to 100 g/l
ammonium hydroxide: up to pH 7.5 to 11.0 which comprises the step of adding to the ammonia sulfamate bath a brightening composition consisting essentially of a pyridine-monocarboxylic acid or amide in a concentration of 0.5 to 10.0 g/l, in combination with at least one dye selected from the group consisting of an azo dye, an acid anthraquinone dye, and an arylamino dye wherein the dye is present in a concentration of 0.01 to 2.0 g/l.

* * * * *